US008723422B2

(12) United States Patent
Diamant et al.

(10) Patent No.: US 8,723,422 B2
(45) Date of Patent: May 13, 2014

(54) SYSTEMS AND METHODS FOR CYLINDRICAL HALL THRUSTERS WITH INDEPENDENTLY CONTROLLABLE IONIZATION AND ACCELERATION STAGES

(75) Inventors: Kevin David Diamant, Irvine, CA (US); Yevgeny Raitses, Princeton, NJ (US); Nathaniel Joseph Fisch, Princeton, NJ (US)

(73) Assignees: The Aerospace Corporation, El Segundo, CA (US); Trustees of Princeton University, Princeton, NJ (US)

( * ) Notice: Subject to any disclaimer, the term of this patent is extended or adjusted under 35 U.S.C. 154(b) by 410 days.

(21) Appl. No.: 13/035,475

(22) Filed: Feb. 25, 2011

(65) Prior Publication Data

US 2012/0217876 A1 Aug. 30, 2012

(51) Int. Cl.
*H05H 1/46* (2006.01)
*H05H 1/24* (2006.01)

(52) U.S. Cl.
USPC ..... 315/111.41; 315/111.21

(58) Field of Classification Search
USPC ..... 315/500, 111.41, 111.21, 111.61
See application file for complete search history.

(56) References Cited

U.S. PATENT DOCUMENTS

| | | | | |
|---|---|---|---|---|
| 5,475,354 | A * | 12/1995 | Valentian et al. | 335/296 |
| 6,448,721 | B2 * | 9/2002 | Raitses et al. | 315/501 |
| 6,777,862 | B2 * | 8/2004 | Fisch et al. | 313/359.1 |
| 2002/0014845 | A1 * | 2/2002 | Raitses et al. | 315/111.81 |
| 2006/0284562 | A1 | 12/2006 | Hruby et al. | |
| 2006/0290287 | A1 | 12/2006 | Kuninaka | |

OTHER PUBLICATIONS

Raitsis et al., Parametric Investigations of a Nonconventional Hall Thruster, May 2001, vol. 8, No. 5, pp. 2579-2586.*
Smirnov et al., Experimanetal and Theoretical Studies of Cylindrical Hall Thrusters, 2007, Physics of Plasmas 14, 057106, pp. 1-12.*
Hofer et al. "A High Specific Impulse Two-Stage Hall Thruster with Plasma Lens Focusing." IEPC-01-036, 27th International Electric Propulsion Conference, Pasadena, CA, Oct. 15-19, 2001.
Kornfeld et al. "Physics and Evolution of HEMP-Thrusters." IEPC 2007-108, 30th International Electric Propulsion Conference, Ann Arbor, Michigan, Sep. 20-24, 2009.
Young et al. "Preliminary Characterization of a Diverging Cusped Field (DCF) Thruster." IEPC 2009-166, 31st International Electric Propulsion Conference, Ann Arbor, Michigan, Sep. 20-24, 2009.
Matlock et al. "Magnetic Field Effects on the Plume of a Diverging Cusped-Field Thruster." AIAA 2010-7104, 46th Joint Propulsion Conference, Nashville, TN, Jul. 25-28, 2010.

* cited by examiner

*Primary Examiner* — Alexander H Taningco
*Assistant Examiner* — David Lotter
(74) *Attorney, Agent, or Firm* — Sutherland, Asbill & Brennan LLP

(57) ABSTRACT

Systems and methods may be provided for cylindrical Hall thrusters with independently controllable ionization and acceleration stages. The systems and methods may include a cylindrical channel having a center axial direction, a gas inlet for directing ionizable gas to an ionization section of the cylindrical channel, an ionization device that ionizes at least a portion of the ionizable gas within the ionization section to generate ionized gas, and an acceleration device distinct from the ionization device. The acceleration device may provide an axial electric field for an acceleration section of the cylindrical channel to accelerate the ionized gas through the acceleration section, where the axial electric field has an axial direction in relation to the center axial direction. The ionization section and the acceleration section of the cylindrical channel may be substantially non-overlapping.

20 Claims, 3 Drawing Sheets

SYSTEMS AND METHODS FOR CYLINDRICAL HALL THRUSTERS WITH INDEPENDENTLY CONTROLLABLE IONIZATION AND ACCELERATION STAGES

STATEMENT OF GOVERNMENT INTEREST

This invention was made with government support under Grant No. DE-ACO2-09CH11466 awarded by the Department of Energy. The government has certain rights in this invention.

FIELD OF THE INVENTION

Embodiments of the invention relate generally to propulsion systems, and more particularly, to systems and methods for cylindrical Hall thrusters with independently controllable ionization and acceleration stages.

BACKGROUND OF THE INVENTION

Propulsion systems are utilized in many low-power space applications. One such type of propulsion system is a cylindrical Hall thruster, which may also be referred to as a Hall effect thruster or a Hall current thruster. Traditional Hall thrusters utilize an anode and cathode to provide for both ionization of gases and acceleration of the ionized gases. Because the same anode and cathode are utilized to control both ionization and acceleration, there are various considerations and tradeoffs between or among power consumption, ionization amount, and acceleration rate. Accordingly, there is an opportunity for systems and methods for cylindrical Hall thrusters with independently controllable ionization and acceleration stages.

BRIEF DESCRIPTION OF THE INVENTION

According to an example embodiment of the invention, there is a cylindrical Hall thruster. The cylindrical Hall thruster may include a cylindrical channel having a center axial direction, a gas inlet for directing ionizable gas to an ionization section of the cylindrical channel, an ionization device that ionizes at least a portion of the ionizable gas within the ionization section to generate ionized gas, and an acceleration device distinct from the ionization device. The acceleration device may provide an axial electric field for an acceleration section of the cylindrical channel to accelerate the ionized gas through the acceleration section, where the axial electric field may have an axial direction in relation to the center axial direction. The ionization section and the acceleration section of the cylindrical channel may be substantially non-overlapping, according to an example embodiment of the invention.

According to another example embodiment of the invention, there is a method for a cylindrical Hall thruster. The method may include: providing a cylindrical channel having a center axial direction; directing ionizable gas to an ionization section of the cylindrical channel; ionizing, by an ionization device, at least a portion of the ionizable gas within the ionization section to generate ionized gas; and accelerating, by an acceleration device distinct from the ionization device, the ionized gas through an acceleration section of the cylindrical channel. The acceleration device may provide an axial electric field for the acceleration section, where the axial electric field may have an axial direction in relation to the center axial direction. The ionization section and the acceleration section of the cylindrical channel are substantially non-overlapping, according to an example embodiment of the invention.

DESCRIPTION OF THE DRAWINGS

Reference will now be made to the accompanying drawings, which are not necessarily drawn to scale, and wherein.

DETAILED DESCRIPTION OF THE INVENTION

Figure 1:
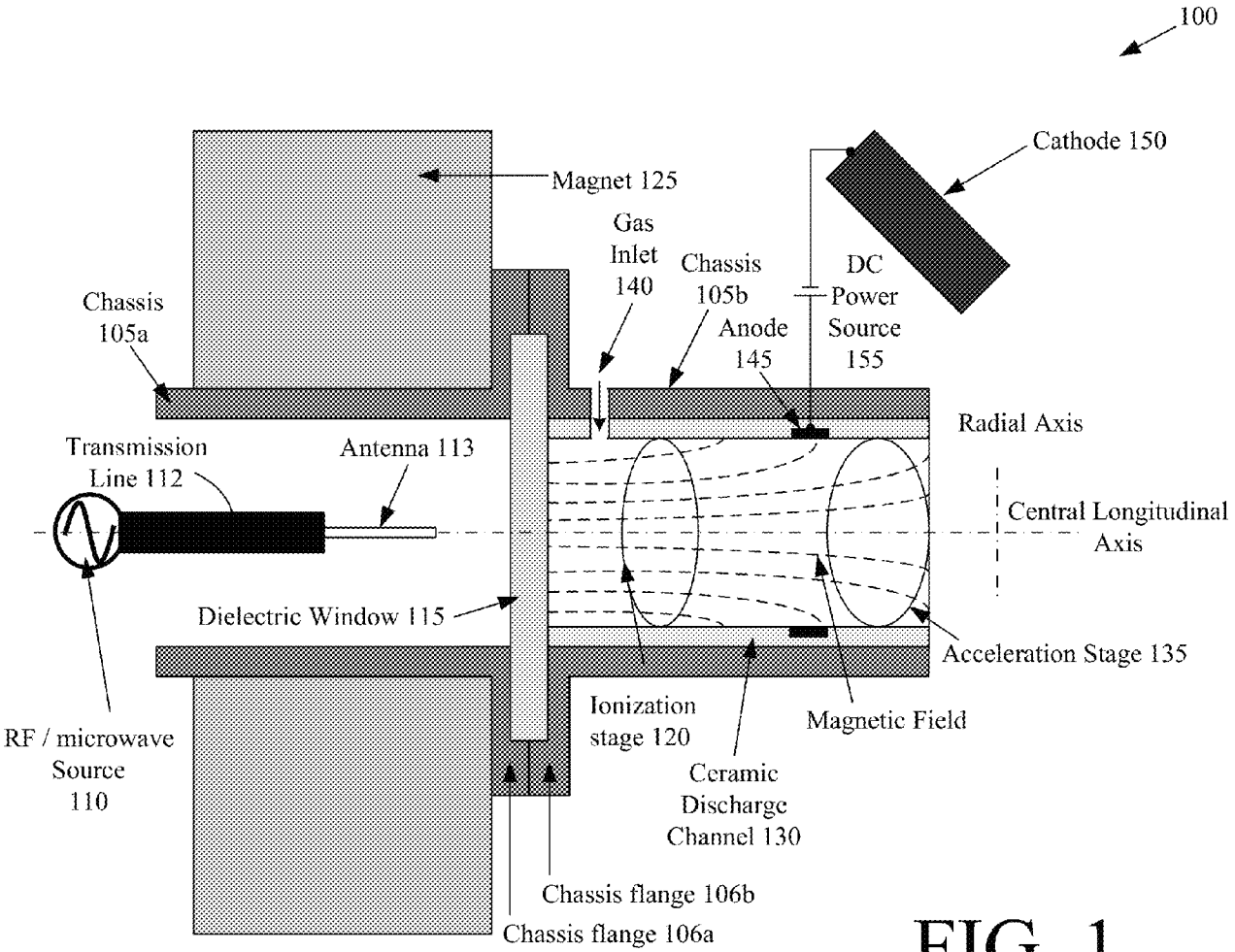
FIG. 1 illustrates an example system for a two-stage cylindrical Hall thruster utilizing electron cyclotron resonance (ECR) ionization, according to an example embodiment of the invention.

Embodiments of the invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Example embodiments of the invention may provide for two-stage cylindrical Hall thrusters for use in a variety of spacecraft propulsion systems, including satellite propulsion. The two-stage cylindrical Hall thrusters in accordance with example embodiments of the invention may have an ionization stage and an acceleration stage. The ionization stage and the acceleration stage may be operated independently of each other. According to an example embodiment of the invention, the ionization stage and the acceleration stage may be substantially non-overlapping in physical positioning. The ionization stage may provide or support the ionization of gases to generate ionized gases. The acceleration stage may accelerate the ionized gases to generate higher velocity exhaust, thereby generating propulsion for the associated spacecraft.

By providing a first ionization stage and a second acceleration stage, the ionization and acceleration can be decoupled. The decoupling of the ionization and acceleration may allow for operation of the cylindrical Hall thruster with a variety of propellant gases, including those that may be difficult to ionize or that may have a low molecular weight. For instance, an example cylindrical Hall thruster in accordance with an example embodiment of the invention can operate with a variety of gases, whether obtained or derived from a closed source (e.g., container having gas or matter from which gas can be derived) or from an external environment. These gases can include inert gases such as xenon and other gases found in planetary atmospheres, including low molecular weight gases or other molecular gases. The decoupling of the ionization and acceleration can also allow for broadening the operating envelope/parameters for the cylindrical Hall thruster. Indeed, an example cylindrical Hall thruster in accordance with example embodiments of the invention may be able to operate under various pressures, and with ion accelerating voltages that are different from the ionization voltages, thereby providing a broader possible range of operating pressures and ion accelerating voltages. Furthermore, an example cylindrical Hall thruster in accordance with an example embodiment of the invention may provide for increased operating efficiency by providing narrow ion energy distribution and/or reducing ion beam divergence. These features and yet other features may be available in accordance with example embodiments of two-stage cylindrical Hall thrusters.

FIG. 1 illustrates an example system 100 for a two-stage cylindrical Hall thruster utilizing electron cyclotron resonance (ECR) ionization, according to an example embodiment of the invention. In FIG. 1, the system 100 may include a cylindrical chassis, which may be comprised of a first cylindrical chassis 105*a* and a second cylindrical chassis 105*b*. The chassis 105*a*, 105*b* may be formed of any variety of materials, including metal (e.g., aluminum, steel, alloys, etc.), ceramic, plastic, or a combination thereof. In an example embodiment of the invention, the first cylindrical chassis 105*a* and the second cylindrical chassis 105*b* may be joined together with respective chassis flanges 106*a*, 106*b*. In an alternative embodiment of the invention, the first cylindrical chassis 105*a* and the second cylindrical chassis 105*b* may be respective portions of a same single cylindrical chassis.

The first cylindrical chassis 105*a* may house or include an ionization source or device within its interior walls or interior portion. In an example embodiment of the invention, the ionization source or device may be an example electron cyclotron resonance (ECR) ionization source. The ECR ionization source or device may be comprised of a radio frequency (RF)/microwave source 110, and a transmission line 112 and/or antenna 113 for delivering or radiating the electromagnetic fields, energy, or waves (e.g., microwaves) generated from the RF/microwave source 110. The RF/microwave source 110 may include virtually any radiation source, including vacuum tube devices (e.g., magnetron, klystron, gyrotron, traveling wave tube, and the like) and solid state devices (e.g. transistors, diodes, etc.). The transmission line 112 may include a microstrip, a coaxial transmission line, a waveguide, or the like. In some example embodiments of the invention, the transmission line 112 can serve as or include an antenna for delivering or radiating the electromagnetic fields or waves (e.g., microwaves). In an alternative embodiment of the invention, the transmission line 112 can be connected to another antenna 113 for delivering or radiating the electromagnetic fields or waves.

According to an example embodiment of the invention, the ionization source housed or provided in the interior of the first cylindrical chassis 105*a* may be separated from the interior of the second cylindrical chassis 105*b* via one or more dielectric windows 115. The dielectric window 115 may operate to prevent plasma or other gases, including ionizable gases, from the interior of the second cylindrical chassis 105*b* from contacting the ionization source housed or provided in the interior of the first cylindrical chassis 105*a*. The dielectric window 115 may be formed of ceramic, glass, plastic, Plexiglas, resins, or another suitable dielectric material. In addition, the first cylindrical chassis 105*a* may include a magnet 125 around its exterior. The magnet 125 may be a permanent magnet, an electromagnet, or any other magnetic device, according to an example embodiment of the invention. The magnet 125 may impose, provide, or support a magnetic field inside the chassis 105*a* and/or chassis 105*b*/ceramic discharge channel 130, where the magnetic field may establish the conditions utilized for electron cyclotron resonance, and may impede the flow of electrons from an externally mounted cathode 150 to an anode 145 located inside the channel 130. In this regard, the magnet 125 may provide a magnetic field having substantial axial as well as radial components. The magnetic field provided by the magnet 125 can also enhance ionization of at least a portion of the ionizable gas within the ionization stage 120, and support an axial electric field within the acceleration stage 135, as likewise discussed herein. It will be appreciated that the extent of ionization provided by the ionization stage 120 may be controlled by varying one or both of the magnetic field strength provided by magnet 125 or the microwave/electromagnetic radiation frequency of the RF/microwave source 110.

Turning now to the second cylindrical chassis 105*b*, there may be provided a cylindrical ceramic discharge channel 130. At or near a first end of the cylindrical ceramic discharge channel 130 closest to the RF/microwave source 110 may be ionization stage 120. At or near the opposite end of the cylindrical ceramic discharge channel 130 near the discharge opening may be an acceleration stage 135. The ionization stage 120 and the acceleration stage 135 of the cylindrical ceramic discharge channel 130 may be substantially non-overlapping. A gas inlet 140 may be arranged with respect to the cylindrical chassis 105*b*/discharge channel 130 (or chassis 105*b*) to direct ionizable gas to or near the ionization stage 120 of the interior of the cylindrical chassis 105*b*. For example, in FIG. 1, the gas inlet 140 may be provided through a portion of the cylindrical chassis 105*b* and the ceramic discharge channel 130. However, the gas inlet 140 can be provided in various other positions, configurations or arrangements with respect to the chassis 105*a*, 105*b* and/or the ceramic discharge channel 130 or dielectric window 115 without departing from example embodiments of the invention. For example, the positions of the gas inlet 140 and the RF/microwave source 110 could be swapped without departing from example embodiments of the invention. In an example embodiment of the invention, the gas inlet 140 may include a valve, including a one-way or directional valve, or a through hole without departing from example embodiments of the invention. If a valve is utilized for the gas inlet 140, then the valve can be controlled or adjusted to direct a desired amount or rate of ionizable gas to or near the ionization stage 120, according to an example embodiment of the invention. Additionally or alternatively, the flow rate from the source of the ionizable gas can be adjusted to obtain the desired amount or rate of ionizable gas through the gas inlet 140, according to an example embodiment of the invention. In addition, it will be appreciated that ionizable gas provided for gas inlet 140 can be obtained or derived from either (i) an external environment or (ii) a container having ionizable gas.

As mentioned above, an acceleration stage 135 may be located at or near the opposite end of the second cylindrical chassis 105*b* near the discharge opening. The operation of the acceleration stage 135 may be supported by an arrangement or configuration of an acceleration device. In an example embodiment of the invention, an example acceleration device may be comprised of an anode 145 that is electrically connected to a cathode 150 via a DC power source 155. In general, the arrangement or configuration of the anode 145 and the cathode 150 may create a voltage differential between the anode 145 and the cathode 150, thereby providing at least an axial electric field in the acceleration stage 135. The axial electric field may support the acceleration of ionized gas through the acceleration stage 135 as one or more ion beams to the discharge opening of the second cylindrical chassis 105*b*, thereby providing thrust or propulsion for the cylindrical Hall thruster. To provide at least an axial electric field, an anode 145 may be located inside the channel 130 immediately prior to the acceleration stage 135, and the cathode 150 may be provided external to the second cylindrical chassis 105*b* near its discharge opening, thereby creating an axial electrical field through the acceleration stage 135 towards the discharge opening. The magnitude of the axial electric field may be adjusted by adjusting the voltage and/or current level of an adjustable DC power source 155, according to an example embodiment of the invention. In an example embodiment of the invention, the anode 145 may be formed cylindrically or annularly in, near, or adjacent to the inner portion of the ceramic discharge channel 130 immediately prior to the acceleration stage 135. The cathode 150 may supply electrons which neutralize the ion beams discharged through the discharge opening, and localize the anode 145-cathode 150 potential drop inside the channel 130. The neutralization of the ion beams, through interaction with the applied magnetic field of magnet 125, may result in the anode 145-cathode 150 potential drop to be localized within or near the acceleration stage 135 that is located near the exit of the discharge channel 130, according to an example embodiment of the invention.

It will be appreciated that the ionization source and the acceleration device may be operated independently of each other. For example, the ionization source may control the intensity, rate, or amount of RF/microwave power that is provided for ionizing the ionizable gas from the gas inlet 140 at the ionization stage 120. As another example, the acceleration device can control the magnitude of the axial electric field provided by the anode 145/cathode 150, thereby controlling the amount of acceleration provided for the ionized gas through the acceleration stage 135. By decoupling the operations of the ionization stage 120 and the acceleration stage 135, the amount of ionization and/or acceleration can be individually controlled without the need to balance the ionization and acceleration required by conventional cylindrical Hall thrusters. Likewise, the decoupling of the ionization and acceleration may allow for operation of the cylindrical Hall thruster of FIG. 1 with a variety of propellant gases, including those that may be difficult to ionize or that may have a low molecular weight. Example propellant gases or ionizable gases may include $N_2$, O, $O_2$, or other gases found in planetary atmospheres. Furthermore, an example cylindrical Hall thruster in accordance with an example embodiment of the invention may provide for increased operating efficiency by providing narrow ion energy distribution and/or reducing ion beam divergence.

During an example operation of the cylindrical Hall thruster of FIG. 1, the RF/microwave source 110 may supply microwave power or other electromagnetic energy to transmission line 112 and/or antenna 113 for radiating ions at a frequency resonant with electron gyromotion, which can ionize the ionizable gas or other propellant gas. Ions that are too large or massive to be influenced by the magnetic field provided by magnet 125 may be accelerated in the acceleration stage 135 having the anode 145-to-cathode 150 (discharge) potential drop. As discussed herein, electrons supplied by the cathode 150 may neutralize the ion beam and localize the discharge potential drop within the channel 130, according to an example embodiment of the invention.

These features and yet other features may be available for the example cylindrical Hall thruster described with respect to FIG. 1. Indeed, many variations of the cylindrical Hall thruster of FIG. 1 are available. For example, there may be variations in the configurations in the location or application of the magnetic field and the RF/microwave source 110. According to one example variation, ECR ionization of ionizable gas or plasmas may be generated in configurations employing multi-polar magnetic fields. According to another example, the antenna 113 for the RF/microwave source 110 may be positioned or configured radially instead of axially, as shown in FIG. 1. Likewise, in another variation, no dielectric window 115 may be necessary such that the transmission line 112 and/or antenna 113 may be directly immersed in the ionizable gas or plasma. Many variations of FIG. 1 are available without departing from example embodiments of the invention.

Figure 2:
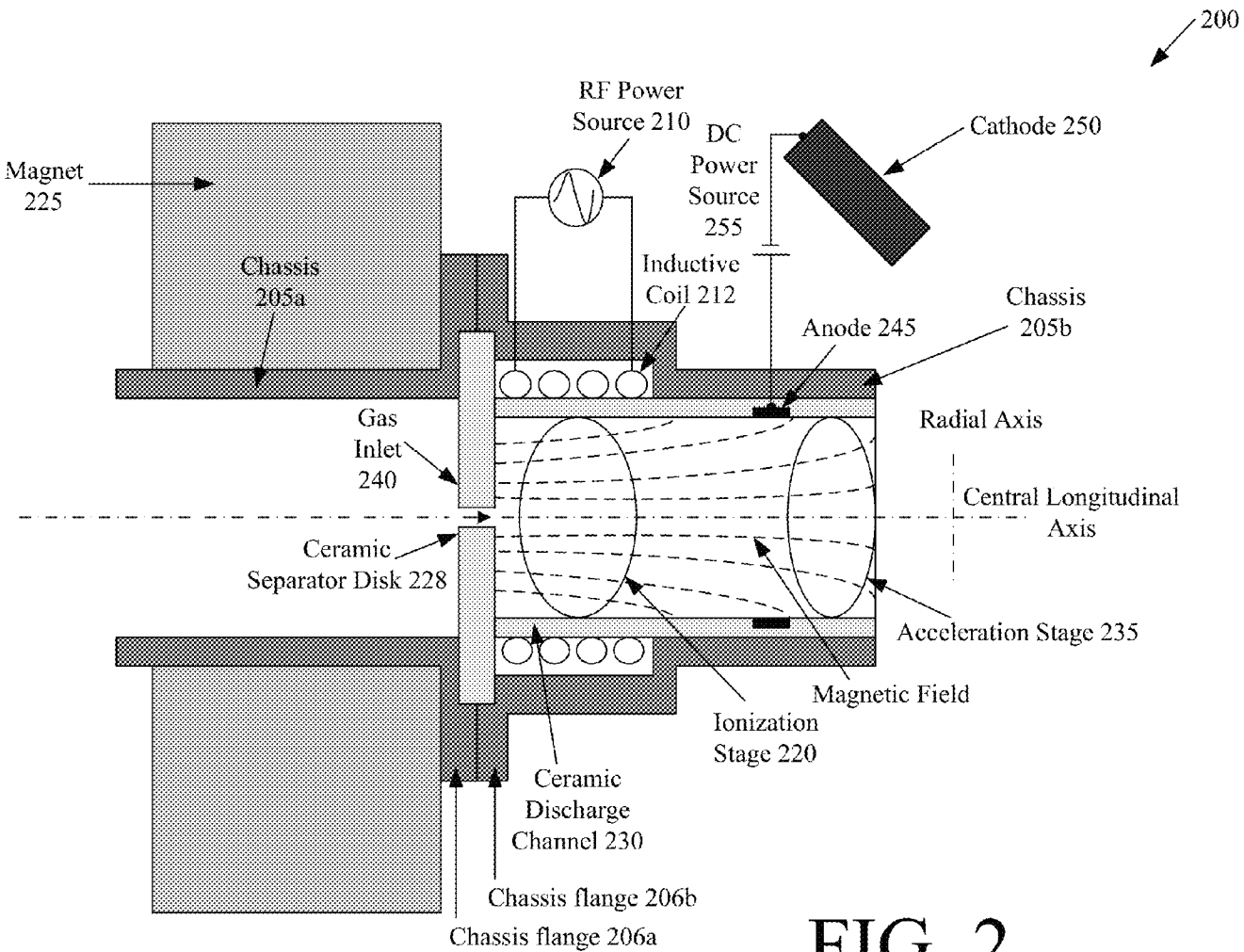
FIG. 2 illustrates an example system for a two-stage cylindrical Hall thruster utilizing inductive ionization, according to an example embodiment of the invention.

FIG. 2 illustrates an example system 200 for a two-stage cylindrical Hall thruster utilizing inductive ionization, according to an example embodiment of the invention. In FIG. 2, the system 200 may be a cylindrical chassis, which may be comprised of a first cylindrical chassis 205*a* and a second cylindrical chassis 205*b*. The chassis 205*a*, 205*b* may be formed of any variety of materials, including metal (e.g., aluminum, steel, alloys, etc.), ceramic, plastic, or a combination thereof. In an example embodiment of the invention, the first cylindrical chassis 205*a* and the second cylindrical chassis 205*b* may be joined together with respective chassis flanges 206*a*, 206*b*. In an alternative embodiment of the invention, the first cylindrical chassis 205*a* and the second cylindrical chassis 205*b* may be respective portions of a same single cylindrical chassis.

According to an example embodiment of the invention, the interior of the first cylindrical chassis 205*a* may be separated from the interior of the second cylindrical chassis 205*b* via a ceramic separator disk 228. The ceramic separator disk 228 may include or be configured with a gas inlet 240 to allow for ionizable gas to be provided from or directed to or near the ionization stage 220 of the interior of the second cylindrical chassis 205*b*. The source of the ionizable gas may be provided in the interior of the first cylindrical chassis 205*a*. In an example embodiment of the invention, the gas inlet 240 may include a valve, including a one-way or directional valve, or a through hole without departing from example embodiments of the invention. If a valve is utilized for the gas inlet 240, then the valve can be controlled or adjusted to direct a desired amount or rate of ionizable gas to or near the ionization stage 220, according to an example embodiment of the invention. Additionally or alternatively, the flow rate from the source of the ionizable gas can be adjusted to obtain the desired amount or rate of ionizable gas through the gas inlet 240, according to an example embodiment of the invention. It will be appreciated that ionizable gas provided for gas inlet 240 can be obtained or derived from either (i) an external environment or (ii) a container having ionizable gas.

In addition, the first cylindrical chassis 205*a* may include a magnet 225 around its exterior. The magnet 225 may be a permanent magnet, an electromagnet, or any other magnetic device, according to an example embodiment of the invention. The magnet 225 may provide a magnetic field having substantial axial as well as radial components to support the movement of ionizable gas along a central longitudinal axis towards the ionization stage 220 of the second chassis 205*b*. The magnetic field provided by the magnet 225 can also enhance ionization of at least a portion of the ionizable gas within the ionization stage 220, and support an axial electric field within the acceleration stage 235, as described herein.

Turning now to the second cylindrical chassis 205*b*, there may be provided a cylindrical ceramic discharge channel 230. In some example embodiments of the invention, the ceramic discharge channel 230 can also include the ceramic separator disk 228, which may be formed substantially perpendicular to the ceramic separator disk 228. At or near a first end of the cylindrical ceramic discharge channel 230 closest to the gas inlet 240, may be ionization stage 220. At or near the opposite end of the cylindrical ceramic discharge channel 230 near the discharge opening may be an acceleration stage 235. The ionization stage 220 and the acceleration stage 235 of the cylindrical ceramic discharge channel 230 may be substantially non-overlapping.

As introduced above, a gas inlet 240 may be arranged with respect to the ceramic separator disk 228 to direct ionizable gas to or near the ionization stage 220 of the interior of the cylindrical chassis 205*b*. In addition, an ionization source may also be provided near the ionization stage 220. As shown in FIG. 2, the ionization source may be an inductive ionization source comprising an RF power source 210 coupled to an inductive coil 212. The inductive coil 212 may be positioned cylindrically or annularly between the chassis 205*b* and the ceramic discharge channel 230 such that the inductive coil generally surrounds at least a portion of the ionization stage 220. Accordingly, when the ionizable gas is provided through the gas inlet 240, the RF power source 210 can operate the inductive coil 212 to ionize the gas and generate ionized gas. In an example embodiment of the invention, the RF power source 210/inductive coil 212 may ionize the gas via fluctuating electric field strengths.

In addition, an acceleration stage 235 may be located at or near the opposite end of the second cylindrical chassis 205*b* near the discharge opening. The operation of the acceleration stage 235 may be supported by an arrangement or configuration of an acceleration device. In an example embodiment of the invention, an example acceleration device may be comprised of an anode 245 that is electrically connected to a cathode 250 via a DC power source 255. The operation of the anode 245 and the cathode 250 is substantially similar to that described with respect to the anode 145 and the cathode 150 of FIG. 1, and need not be discussed in further detail with respect to FIG. 2.

It will be appreciated that the ionization source and the acceleration device in FIG. 2 may be operated independently of each other. For example, the ionization source may control the intensity, frequency, or amount of one or more electric fields that are provided for ionizing the ionizable gas from the gas inlet 240 at the ionization stage 220. As another example, the acceleration device can control the magnitude of the axial electric field provided by the anode 245/cathode 250, thereby controlling the amount of acceleration provided for the ionized gas through the acceleration stage 235. By decoupling the operations of the ionization stage 220 and the acceleration stage 235, the amount of ionization and/or acceleration can be individually controlled without the need to balance the ionization and acceleration required by conventional cylindrical Hall thrusters. Likewise, the decoupling of the ionization and acceleration may allow for operation of the cylindrical Hall thruster of FIG. 2 with a variety of propellant gases, including those that may be difficult to ionize or that may have a low molecular weight. Furthermore, an example cylindrical Hall thruster in accordance with an example embodiment of the invention may provide for increased operating efficiency by providing narrow ion energy distribution and/or reducing ion beam divergence. These features and yet other features may be available for the example cylindrical Hall thruster described with respect to FIG. 2.

It will be appreciated that many variations of the cylindrical Hall thrusters of FIGS. 1 and 2 are available without departing from example embodiments of the invention.

Figure 3:
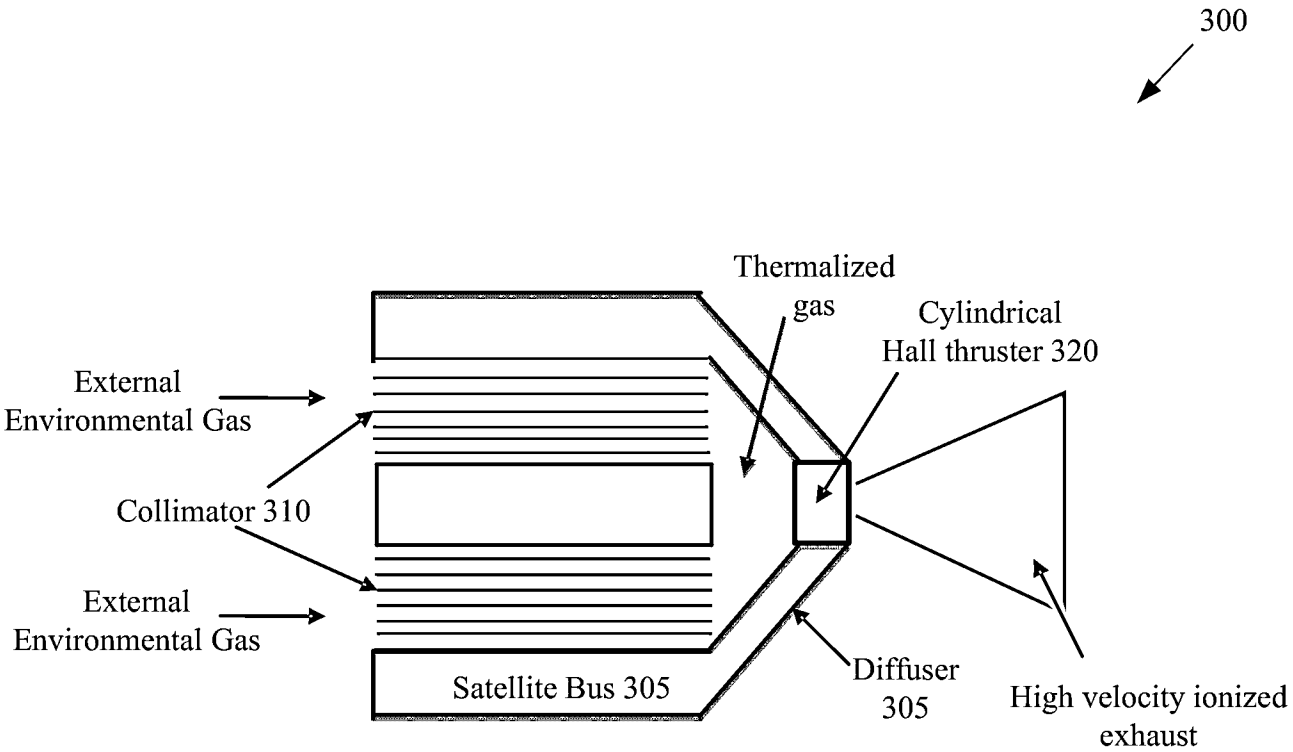
FIG. 3 illustrates an example satellite utilizing an example two-stage cylindrical Hall thruster in accordance with an example embodiment of the invention.

FIG. 3 illustrates an example satellite 300 utilizing an example two-stage cylindrical Hall thruster in accordance with an example embodiment of the invention. The example satellite 300 may include a satellite bus 305, which may include a collimator 310, a diffuser 315, and a cylindrical Hall thruster 320. As shown in FIG. 3, external environmental gas may be moved through the collimator 310 to produce parallel beams of external environmental gas to provide thermalized gas. The thermalized gas is directed by the diffuser 315 into a mixing chamber or gas inlet of the cylindrical Hall thruster 320. The cylindrical Hall thruster 320 can operate substantially the same as that described with respect to FIGS. 1 and 2, where the ionization stage generates ionized gas from the thermalized gas, and the acceleration stage accelerates the ionized gas, which is discharged from the discharge opening of the discharge channel, thereby resulting in high velocity ionized exhaust and generating propulsion. It will be appreciated that the external environmental gas can include $N_2$, O, $O_2$, or other gases found in planetary atmospheres.

Many modifications and other embodiments of the invention set forth herein will be apparent having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A cylindrical Hall thruster, comprising:

a cylindrical channel having a center axial direction and a discharge channel adjacent to a first chassis;

a second chassis coupled to the first chassis via respective chassis flanges, the second chassis comprising a first power source for ionizing at least a portion of ionizable gas in the cylindrical channel to generate ionized gas;

a gas inlet for directing the ionizable gas to an interior of the cylindrical channel, wherein the gas inlet comprises an aperture within at least a portion of the discharge channel; and a second power source providing an axial electric field for accelerating the portion of ionized gas through the discharge channel of the cylindrical channel, wherein the axial electric field has an axial direction in relation to the center axial direction, and wherein the second power source comprises an anode located within the discharge channel at a location closer to a discharge opening of the cylindrical channel than the first power source and the gas inlet.

2. The cylindrical Hall thruster of claim 1, wherein the first power source includes one or both of (i) an electron cyclotron resonance (ECR) ionization device, or (ii) an inductive ionization device.

3. The cylindrical Hall thruster of claim 2, wherein the first power source includes the electron cyclotron resonance (ECR) ionization device, wherein the ECR ionization device includes a radiation source and a transmission line to radiate electromagnetic waves from the radiation source.

4. The cylindrical Hall thruster of claim 3, wherein the electromagnetic waves comprise microwaves.

5. The cylindrical Hall thruster of claim 3, wherein the transmission line includes one or more of (i) an antenna, (ii) a microstrip, (iii) a waveguide, or (iv) a coaxial transmission line.

6. The cylindrical Hall thruster of claim 2, wherein the first power source includes the electron cyclotron resonance (ECR) ionization device, and further comprising:

a dielectric window positioned in the cylindrical channel between the electron cyclotron resonance (ECR) ionization device and the gas inlet, wherein the dielectric window permits electromagnetic waves to pass through to ionize the at least the portion of ionizable gas within the cylindrical channel, wherein the dielectric window prevents the ionizable gas from contacting the first power source.

7. The cylindrical Hall thruster of claim 2, wherein the first power source comprises a radio frequency (RF) power source applied to inductive coils, the inductive coils formed annularly around at least a portion of the cylindrical channel.

8. The cylindrical Hall thruster of claim 1, wherein each of the first power source and the second power source are independently controllable.

9. The cylindrical Hall thruster of claim 1, wherein the second power source further comprises a cathode, the cathode provided externally from the cylindrical channel.

10. The cylindrical Hall thruster of claim 1, wherein the second power source further comprises a cathode, and wherein the anode and the cathode are coupled to an adjustable DC power source, the adjustable DC power source for controlling a magnitude of the axial electric field.

11. The cylindrical Hall thruster of claim 1, wherein the ionizable gas is obtained or derived from (i) an external environment or (ii) a container having ionizable gas.

12. The cylindrical Hall thruster of claim 1, further comprising:

a magnetic device providing a magnetic field having axial and radial components, the magnetic field for enhancing ionization of at least the portion of the ionizable gas within the cylindrical channel, and for supporting the axial electric field for ion acceleration within the cylindrical channel.

13. A method for a cylindrical Hall thruster, comprising:

providing (i) a cylindrical channel having a center axial direction, (ii) a discharge channel adjacent to a first chassis; and (iii) a second chassis coupled to the first chassis via respective chassis flanges, the second chassis comprising a first power source for ionizing at least a portion of ionizable gas in the cylindrical channel to generate ionized gas;

directing, via a gas inlet, the ionizable gas to an interior of the cylindrical channel, wherein the gas inlet comprises an aperture within at least a portion of the discharge channel;

ionizing, by the first power source, the portion of ionizable gas to generate ionized gas; and accelerating, by a second power source, the portion of ionized gas through the discharge channel of the cylindrical channel, wherein the second power source provides an axial electric field for the acceleration, wherein the axial electric field has an axial direction in relation to the center axial direction, and wherein the second power source comprises an anode located within the discharge channel at a location closer to a discharge opening of the cylindrical channel than the first power source and the gas inlet.

14. The method of claim 13, wherein the first power source includes one or both of (i) an electron cyclotron resonance (ECR) ionization device, or (ii) an inductive ionization device.

15. The method of claim 14, wherein the first power source includes the electron cyclotron resonance (ECR) ionization device, wherein the ECR ionization device includes a radiation source and a transmission line to radiate electromagnetic waves from the radiation source.

16. The method of claim 14, wherein the first power source includes the electron cyclotron resonance (ECR) ionization device, and further comprising:

positioning a dielectric window in the cylindrical channel between the electron cyclotron resonance (ECR) ionization device and the gas inlet, wherein the dielectric window permits electromagnetic waves to pass through to ionize the at least the portion of ionizable gas within the cylindrical channel, wherein the dielectric window prevents the ionizable gas from contacting the first power source.

17. The method of claim 14, wherein the first power source comprises a radio frequency (RF) power source applied to inductive coils, the inductive coils formed annularly around at least a portion of the cylindrical channel.

18. The method of claim 13, wherein each of the first power source and the second power source are independently controllable.

19. The method of claim 13, wherein the second power source further comprises a cathode, the cathode provided externally from the cylindrical channel.

20. The method of claim 13, further comprising:

providing a magnetic field having axial and radial components, the magnetic field for enhancing ionization of at least the portion of the ionizable gas within the cylindrical channel, and for supporting the axial electric field for ion acceleration within the cylindrical channel.

* * * * *